US011719254B2

(12) United States Patent
Xu et al.

(10) Patent No.: US 11,719,254 B2
(45) Date of Patent: Aug. 8, 2023

(54) MICRO WATER PUMP

(71) Applicant: AAC Microtech (Changzhou) Co., Ltd., Changzhou (CN)

(72) Inventors: Detao Xu, Shenzhen (CN); Fanghua Ling, Shenzhen (CN); Sensen Yang, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 17/534,394

(22) Filed: Nov. 23, 2021

(65) Prior Publication Data

US 2022/0170481 A1 Jun. 2, 2022

(30) Foreign Application Priority Data

Nov. 27, 2020 (CN) ..... 202022812013.2

(51) Int. Cl.

| | |
|---|---|
| ***F04D 29/42*** | (2006.01) |
| ***F04D 13/06*** | (2006.01) |
| ***F04D 29/60*** | (2006.01) |
| ***F04D 29/043*** | (2006.01) |

(52) U.S. Cl.

CPC ..... *F04D 29/426* (2013.01); *F04D 13/06* (2013.01); *F04D 29/043* (2013.01); *F04D 29/605* (2013.01)

(58) Field of Classification Search

CPC ..... F04D 29/426; F04D 13/06; F04D 29/043; F04D 29/605

See application file for complete search history.

(56) References Cited

U.S. PATENT DOCUMENTS

2001/0007519 A1* 7/2001 Nishio ..... G11B 19/2009 360/99.08

2016/0146219 A1* 5/2016 Lyon ..... F04D 29/5806 417/366

* cited by examiner

*Primary Examiner* — Grant Moubry
*Assistant Examiner* — Ruben Picon-Feliciano
(74) *Attorney, Agent, or Firm* — W&G Law Group

(57) ABSTRACT

The present disclosure provides a micro water pump, including: a housing having a base, an upper cover engaging with the base, an inner cavity, an inlet communicated with the inner cavity, and an outlet communicated with the inner cavity. A drive mechanism installed in the housing, includes a rotating shaft, an impeller arranged in the inner cavity and rotatably connected with the rotating shaft, a rotor installed in the impeller, and a stator installed in the base for driving the rotor to rotate. The upper cover includes a body part, and an accommodation slot formed by sinking from the surface of the body part close to the base; one end of the rotating shaft is embedded in the base, and the other end is accommodated in the accommodation slot. Whole strength of the micro water pump is enhanced thereby.

9 Claims, 5 Drawing Sheets

MICRO WATER PUMP

FIELD OF THE PRESENT DISCLOSURE

The present disclosure relates to fluid machinery, in particular to a micro water pump.

DESCRIPTION OF RELATED ART

A micro water pump, usually used to lift liquid, transport liquid or increase pressure of liquid is called micro water pump. It is currently widely used in new energy vehicles, computer water cooling systems, solar fountains, desktop fountains and other fields.

As for micro water pump in the related art, the impeller of the micro water pump rotates around the axis under the force of a magnetic field. The impeller drives the coolant circulation, and the shaft provides support for the impeller.

However, in the related technology of micro water pump, the shaft center and the upper cover are usually supported by a cantilever beam structure, that is, the interval between the axis and the upper cover is set, the impeller and the upper cover cannot form a stable connection structure. This makes the support and drop reliability between the shaft and the upper cover weak.

Therefore, it is necessary to provide a micro water pump with high shaft strength, good support performance, and better impeller rotation stability and drop reliability to solve the above problems.

SUMMARY OF THE PRESENT INVENTION

One of the objects of the present invention is to provide a micro water pump with enhanced strength.

To achieve the above-mentioned objects, the present invention provides a micro water pump, comprising: a housing having a base, an upper cover engaging with the base, an inner cavity, an inlet communicated with the inner cavity, and an outlet communicated with the inner cavity; a drive mechanism installed in the housing, comprises a rotating shaft, an impeller arranged in the inner cavity and rotatably connected with the rotating shaft, a rotor installed in the impeller, and a stator installed in the base for driving the rotor to rotate.

The upper cover includes a body part, and an accommodation slot formed by sinking from the surface of the body part close to the base; one end of the rotating shaft is embedded in the base, and the other end is accommodated in the accommodation slot.

In addition, the rotating shaft comprises a first end surface and a second end surface arranged relatively parallel, a sidewall surface connecting the first end surface and the second end surface, and a plurality of fixing slots formed by sinking from one end of the sidewall surface close to the first end surface toward the axis; one end of the rotating shaft close to the first end surface is embedded in the base; one end of the rotating shaft close to the second end surface is accommodated in the accommodation slot.

In addition, the plurality of fixing slots is in the same shape; the multiple fixing slots are evenly distributed along the circumferential direction of the rotating shaft.

In addition, the accommodation slot comprises a groove bottom surface and a groove side surface formed by bending and extending from the groove bottom surface in a direction close to the base a gap is formed between the groove bottom surface and the second end surface; and the groove side surface abuts against the sidewall surface.

In addition, one of the base and the upper cover is provided with a first circular groove surrounding the inner cavity; the housing further comprises a sealing ring at least partially embedded in the first circular groove.

In addition, the impeller comprises a circular part, an installation part located inside the circular part, and a blade; the installation part is rotatably connected with the rotating shaft, and the blade is arranged on the outer sidewall of the circular part. The rotor is a circular magnet installed in the circular part or the installation part.

In addition, the rotor is fixed to the inner sidewall of the circular part by gluing.

In addition, the base comprises a main body part and a second circular groove formed by sinking a surface of the main body part away from the upper cover to a direction close to the upper cover; the stator is embedded in the second circular groove.

In addition, the base further comprises an installation slot which is close to the second circular groove and formed by sinking from the surface of the main body part away from the upper cover to the direction close to the upper cover; the micro water pump further comprises a circuit board installed in the installation slot for being electrically connected to the stator through a cable.

BRIEF DESCRIPTION OF THE DRAWINGS

Many aspects of the exemplary embodiments can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENTS

The present disclosure will hereinafter be described in detail with reference to exemplary embodiments. To make the technical problems to be solved, technical solutions and beneficial effects of the present disclosure more apparent, the present disclosure is described in further detail together with the figures and the embodiments. It should be understood the specific embodiments described hereby is only to explain the disclosure, not intended to limit the disclosure.

It should be noted that all directional indicators (such as up, down, left, right, front, back, inside, outside, top, bottom . . . ) in the embodiments of the present invention are only used to explain that they are in a specific posture (As shown in the Fig. below), the relative positional relationship between the components, etc., if the specific posture changes, the directional indication will also change accordingly.

It should also be noted that when an element is referred to as being "fixed on" or "arranged on" another element, the element may be directly on the other element or there may be a centering element at the same time. When an element is referred to as being "connected" to another element, it can be directly connected to the other element or an intermediate element may be present at the same time.

Figure 1:
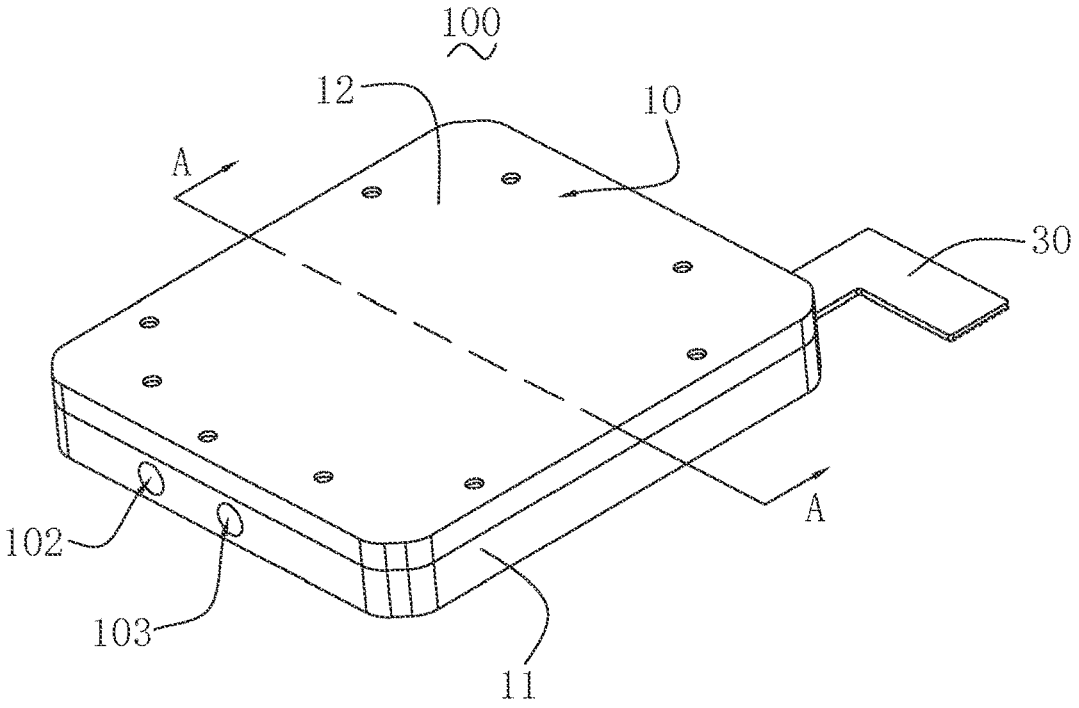
FIG. 1 is an isometric view of a micro water pump in accordance with an exemplary embodiment of the present disclosure.
Figure 2:
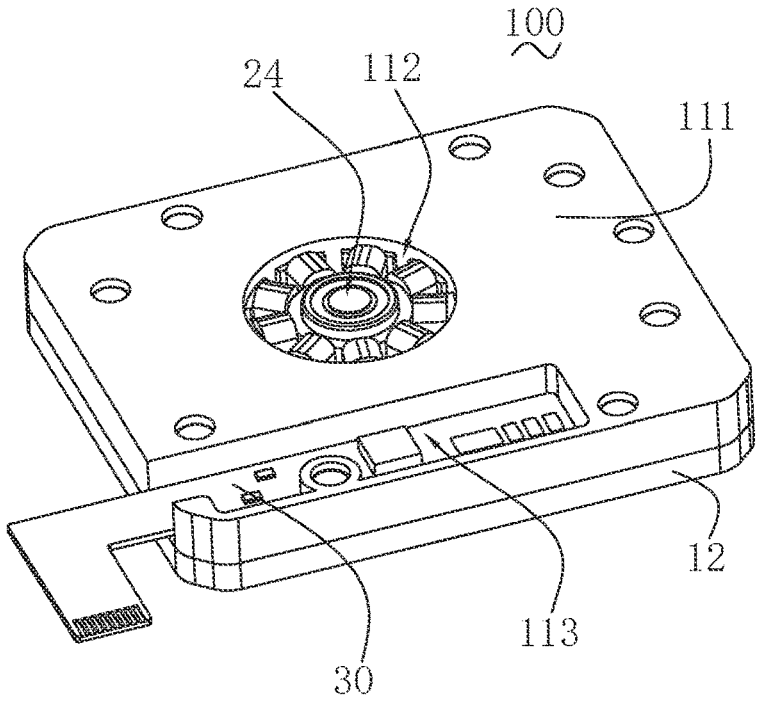
FIG. 2 is an isometric view of the micro water pump in FIG. 1, but from another aspect.
Figure 3:
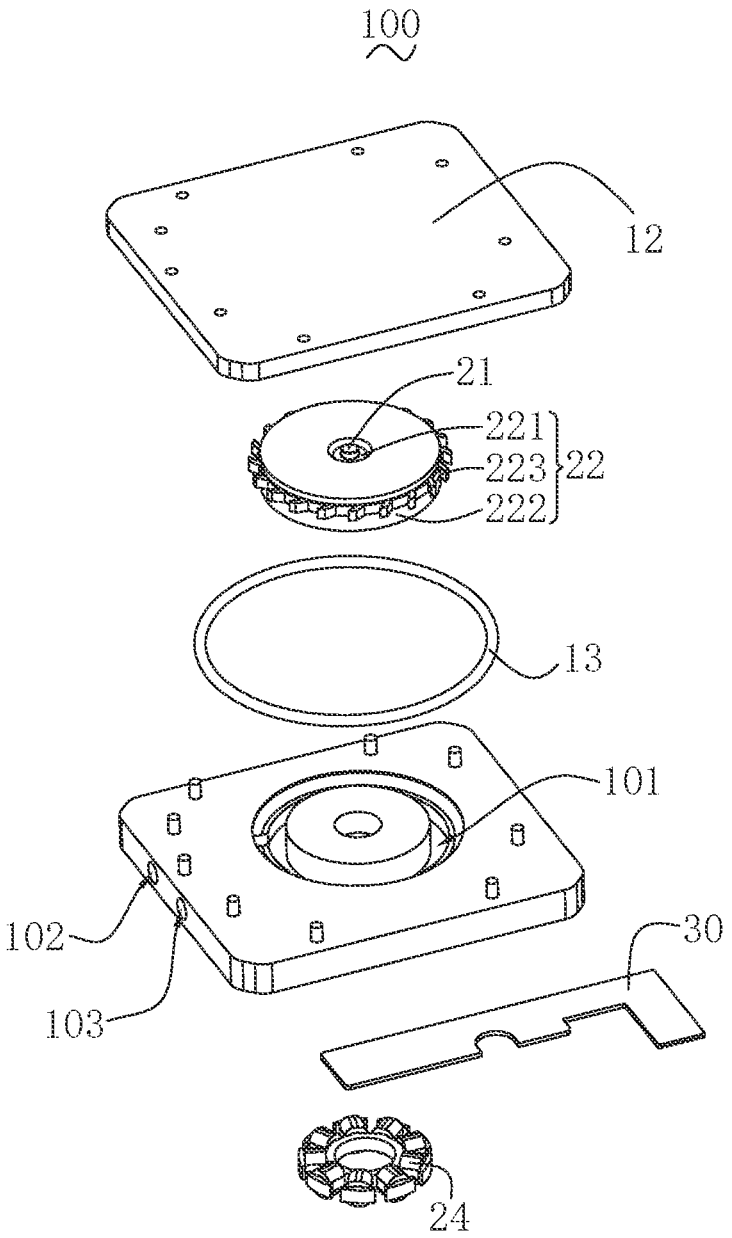
FIG. 3 is an isometric and exploded view of the micro water pump in FIG. 1.
Figure 4:
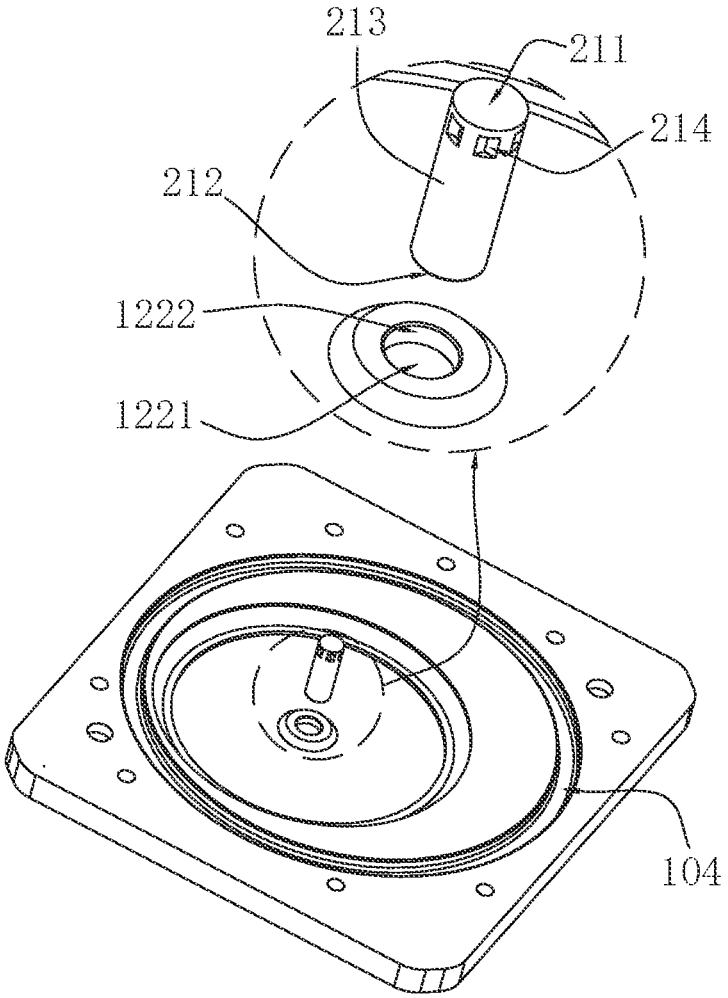
FIG. 4 is an exploded view of a rotating shaft and an upper cover of the micro water pump.
Figure 5:
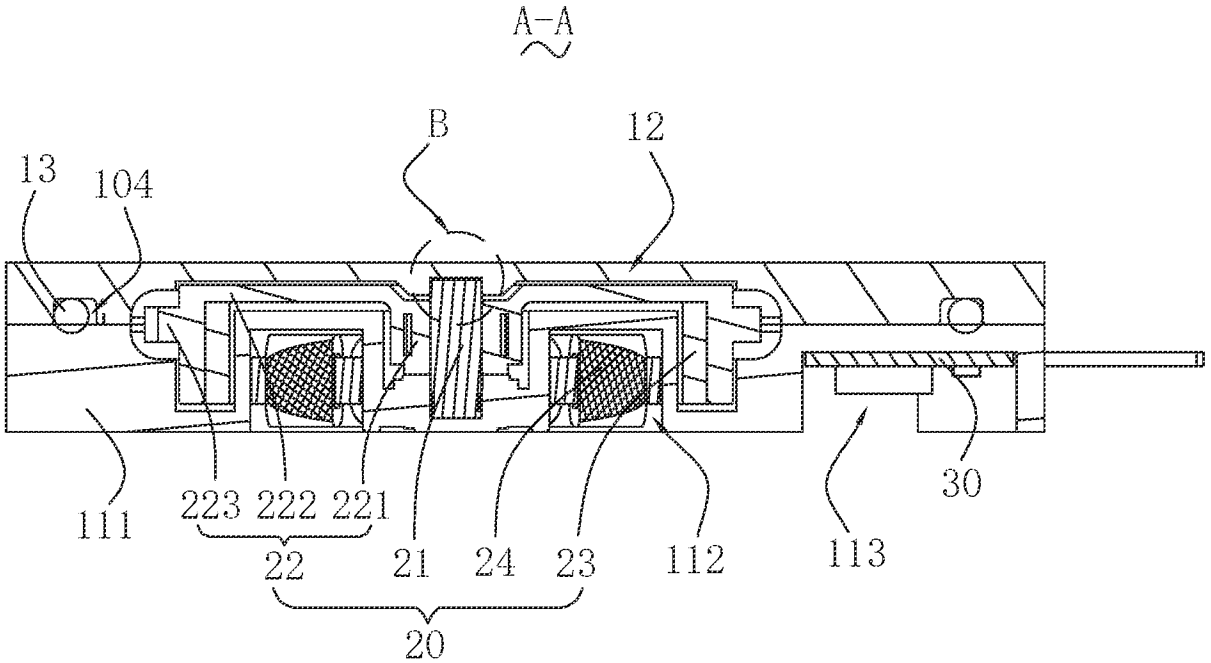
FIG. 5 is a cross-sectional view of the micro water pump taken along line AA in FIG. 1.
Figure 6:
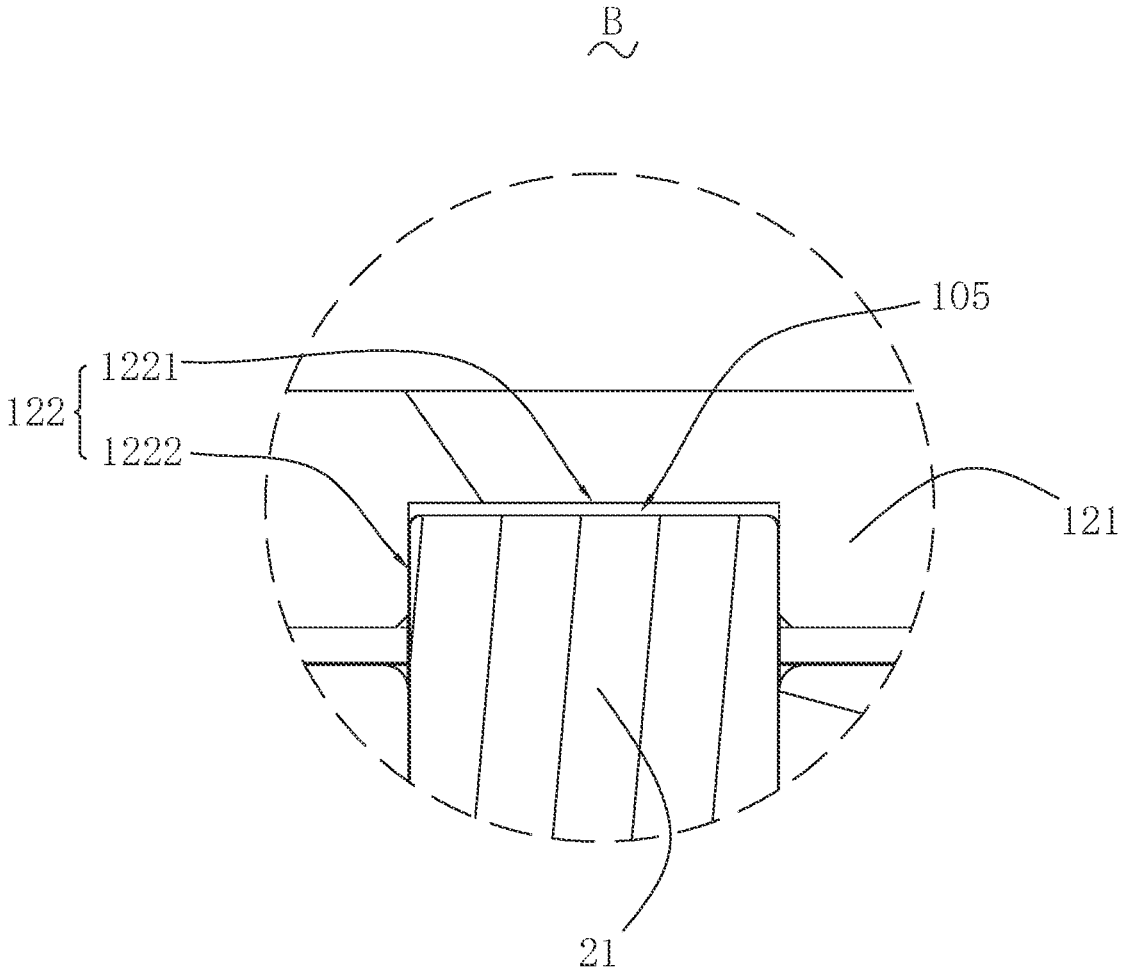
FIG. 6 is an enlarged view of part B in FIG. 5.

Please refer to FIGS. 1-6. The present invention provides a micro water pump 100. The micro water pump 100 comprises a housing 10, a drive mechanism 20 accommodated in the housing 10, and a circuit board 30 placed on the housing 10. Wherein, the housing 10 is provided with an inner cavity 101, an inlet 102 connected to the inner cavity 101, and an outlet 103 connected to the inner cavity 101. The drive mechanism 20 is installed in the housing 10 to drive liquid from the inlet 102 into the inner cavity 101 and discharged from the outlet 103.

The housing 10 comprises a base 11, an upper cover 12 combined with the base 11, and a sealing ring 13. The inner cavity 101 is enclosed by the base 11 and the upper cover 12 together. Wherein, one of the base 11 and the upper cover 12 is provided with a first circular groove 104 surrounding the inner cavity 101. The sealing ring 13 is at least partially embedded in the first circular groove 104 to prevent the liquid in the inner cavity 101 from leaking out of the gap between the upper cover 12 and the base 11.

The base 11 comprises a main body part 111, a second circular groove 112 formed by sinking from the surface of the main body part 111 away from the upper cover 12 toward the direction close to the upper cover 12, and an installation slot 113 formed by sinking from the surface of the main body part 111 away from the upper cover 12 toward the direction close to the upper cover 12. Wherein, the circuit board 30 is installed in the installation slot 113. The circuit board 30 and the drive mechanism 20 are electrically connected by a cable.

The upper cover 12 comprises a body part 121 and an accommodation slot 122 formed by sinking from the surface of the body part 121 close to the base 11.

The accommodation slot 122 comprises a groove bottom surface 1221 and a groove side surface 1222 formed by bending and extending from the groove bottom surface 1221 toward the direction close to the base 11.

The drive mechanism 20 comprises a rotating shaft 21, an impeller 22 installed in the inner cavity 101 and rotatably connected to the rotating shaft 21, a rotor 23 installed in the impeller 22, and a stator 24 installed on the base 11 and used to drive the rotor 23 to rotate.

One end of the rotating shaft 21 is embedded in the base 11, and the other end is accommodated in the accommodation slot 122. This arrangement makes a "tube-supported beam structure" formed between the housing 10 and the rotating shaft to replace the "cantilever beam structure" in the related art. The supporting strength of the rotating shaft 21 is enhanced, the rotation stability of the impeller 22 is improved, and at the same time, the drop stability of the micro water pump 100 is stronger.

Specifically, the rotating shaft 21 comprises a first end surface 211 and a second end surface 212 that are arranged relatively parallel, a sidewall surface 213 connecting the first end surface 211 and the second end surface 212, and a plurality of fixing slots 214 formed by sinking from an end of the sidewall surface 213 close to the first end surface 211 toward the axis. One end of the rotating shaft 21 close to the first end surface 211 is embedded in the base 11. One end of the rotating shaft 21 close to the second end surface 212 is accommodated in the accommodation slot 122. When the fixing slot 214 is used for injection molding of the rotating shaft 21 and the base 11, the base 11 can be partially embedded in the fixing slot 214, making the connection between the rotating shaft 21 and the base 11 stronger.

Preferably, the plurality of fixing slots 214 have the same shape, and the plurality of fixing slots 214 are evenly distributed along the circumference of the rotating shaft 21.

In this embodiment, a gap 105 is formed between the second end surface 212 and the groove bottom surface 1221, and the sidewall surface 213 abuts the groove side surface 1222. With this arrangement, compared with the related art micro water pump, the gap 105 between the second end surface 212 and the upper cover 12 is smaller. In turn, the rotation stability of the impeller 22 is stronger. At the same time, by using the groove side surface 1222 to abut against the sidewall surface 213, the structural stability of the rotating shaft 21 is strengthened, and the drop stability of the micro water pump 100 is improved.

The impeller 22 comprises an installation part 221, a circular part 222 and a blade 223. The installation part 221 is set in the internal test of the circular part 222. The installation part 221 is rotatably connected with the rotating shaft 21. The blade 223 is arranged on the outer sidewall of the circular part 222.

The rotor 23 is a circular magnet installed in the circular part 222 or the installation part 221.

Preferably, in this embodiment, the rotor 23 is fixed to the inner sidewall of the circular part 222 or the outer sidewall of the installation part 221 by gluing. Of course, the rotor 23 is not limited to be fixed on the inner sidewall of the circular part 222 or the outer sidewall of the installation part 221 by gluing. For example, the rotor 23 can also be embedded in the circular part 222 by over-injection.

The stator 24 is embedded in the second circular groove 112. During the working process of the micro water pump 100, the circuit board 30 energizes the stator 24 with alternating current. According to the principle of electromagnetic induction, the stator 24 generates a rotating magnetic field, the rotor 23 is rotated by the ampere force in the rotating magnetic field, and the rotating rotor 23 drives the impeller 22 to rotate. The liquid enters the inner cavity 101 from the inlet 102, rotates at a high speed under the push of the impeller 22, and performs centrifugal movement. When the liquid reaches the outlet 103, it is thrown out from the outlet 103. After the liquid is thrown out, the pressure in the inner cavity 101 decreases, which is much lower than the atmospheric pressure. The external fluid is replenished from the inlet 102 into the inner cavity 101 under the action of atmospheric pressure, and the above-mentioned actions are repeatedly implemented to realize the delivery of the liquid.

As for the micro water pump 100 provided by the present invention, the accommodation slot 122 is formed by arranging a recess on the surface of the body part 121 close to the base 11, so that one end of the rotating shaft 21 is embedded in the base 11, and the other end is accommodated in the accommodation slot 122. Instead of the cantilever beam structure in the related art, the supporting strength of the rotating shaft 21 is enhanced, and the rotation stability of the impeller 22 is improved. At the same time, the micro water pump 100 provided by the present invention can reduce the gap between the rotating shaft 21 and the upper cover 12. The overall strength of the micro water pump 100 is enhanced, and the drop reliability is also more guaranteed.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A micro water pump, comprising:

a housing having a base, an upper cover engaging with the base, an inner cavity, an inlet communicated with the inner cavity, and an outlet communicated with the inner cavity;

a drive mechanism installed in the housing, comprises a rotating shaft, an impeller arranged in the inner cavity and rotatably connected with the rotating shaft, a rotor installed in the impeller, and a stator installed in the base for driving the rotor to rotate; wherein the rotating shaft comprises a first end surface and a second end surface arranged relatively parallel, a sidewall surface connecting the first end surface and the second end surface;

the upper cover includes a body part, and an accommodation slot formed by sinking from a surface of the body part close to the base;

one end of the rotating shaft close to the first end surface is embedded in the base; one end of the rotating shaft close to the second end surface is accommodated in the accommodation slot;

the accommodation slot comprises a groove bottom surface and a groove side surface formed by bending and extending from the groove bottom surface in a direction close to the base; the groove side surface abuts against the sidewall surface.

2. The micro water pump as described in claim 1, wherein, the rotating shaft further comprises a plurality of fixing slots formed by sinking from one end of the sidewall surface close to the first end surface toward the axis; the fixing slot is used for injection molding of the rotating shaft and the base, the base is partially embedded in the fixing slot.

3. The micro water pump as described in claim 2, wherein, the plurality of fixing slots is in the same shape; the multiple fixing slots are evenly distributed along the circumferential direction of the rotating shaft.

4. The micro water pump as described in claim 2, wherein, a gap is formed between the groove bottom surface and the second end surface.

5. The micro water pump as described in claim 1, wherein, one of the base and the upper cover is provided with a first circular groove surrounding the inner cavity; the housing further comprises a sealing ring at least partially embedded in the first circular groove.

6. The micro water pump as described in claim 1, wherein, the impeller comprises a circular part, an installation part located inside the circular part, and a blade; the installation part is rotatably connected with the rotating shaft, and the blade is arranged on the outer sidewall of the circular part; and wherein the rotor is a circular magnet installed in the circular part or the installation part.

7. The micro water pump as described in claim 6, wherein, the rotor is fixed to the inner sidewall of the circular part by gluing.

8. The micro water as described in claim 1, wherein, the base comprises a main body part and a second circular groove formed by sinking a surface of the main body part away from the upper cover to a direction close to the upper cover; the stator is embedded in the second circular groove.

9. The micro water pump as described in claim 8, wherein, the base further comprises an installation slot which is close to the second circular groove and formed by sinking from the surface of the main body part away from the upper cover to the direction close to the upper cover; the micro water pump further comprises a circuit board installed in the installation slot for being electrically connected to the stator through a cable.

* * * * *